United States Patent [19]

Thomanek

[11] 4,111,126

[45] Sep. 5, 1978

[54] WARHEAD FOR USE AGAINST ARMORED TARGETS

[75] Inventor: Franz Rudolf Thomanek, Sandizell b. Schrobenhausen, Germany

[73] Assignee: Messerschmitt-Bölkow-Blohm Gesellschaft mit beschränkter Haftung, Ottobrunn, Germany

[21] Appl. No.: 372,404

[22] Filed: Jun. 20, 1973

[30] Foreign Application Priority Data

Jan. 14, 1969 [DE] Fed. Rep. of Germany ..... 1901472

[51] Int. Cl.[2] ..... F42B 11/14

[52] U.S. Cl. ..... 102/52; 102/56 SC

[58] Field of Search ..... 102/52, 56, 24 H, 24 C, 102/56 HC

[56] References Cited

U.S. PATENT DOCUMENTS

| | | | |
|---|---|---|---|
| 2,797,892 | 7/1957 | Ryan | 102/24 HC |
| 2,972,948 | 2/1961 | Kray | 102/56 |
| 2,980,017 | 4/1961 | Castel | 102/24 HC |
| 3,159,102 | 12/1964 | Riedl et al. | 102/24 HC |
| 3,215,074 | 11/1965 | Robinson, Jr. et al. | 102/24 HC |
| 3,373,687 | 3/1968 | Simmons | 102/56 |
| 3,416,449 | 12/1968 | Brothers | 102/56 |
| 3,661,086 | 5/1972 | Thomanek et al. | 102/56 |

FOREIGN PATENT DOCUMENTS

| | | | |
|---|---|---|---|
| 341,743 | 11/1959 | Switzerland | 102/24 HC |
| 940,705 | 10/1963 | United Kingdom | 102/24 HC |

*Primary Examiner*—Harold Tudor
*Attorney, Agent, or Firm*—Toren, McGeady and Stanger

[57] ABSTRACT

A warhead for use against armored targets, comprising a shaped charge and an aftereffect caused by a second annular explosive charge located in front of the shaped charge, with the explosive charge arranged at the base of a hollow body (nozzle) tapered in target direction. A funnel-shaped sleeve is disposed between the shaped charge and the second explosive charge, and detonation transmission elements are arranged on its outer circumference. The jet from the shaped charge passes the second explosive charge prior to the latter's detonation. Behind the hole produced by the shaped charge jet an aftereffect takes place which is caused by the active mass flow accelerated in axial direction by the second explosive charge.

13 Claims, 1 Drawing Figure

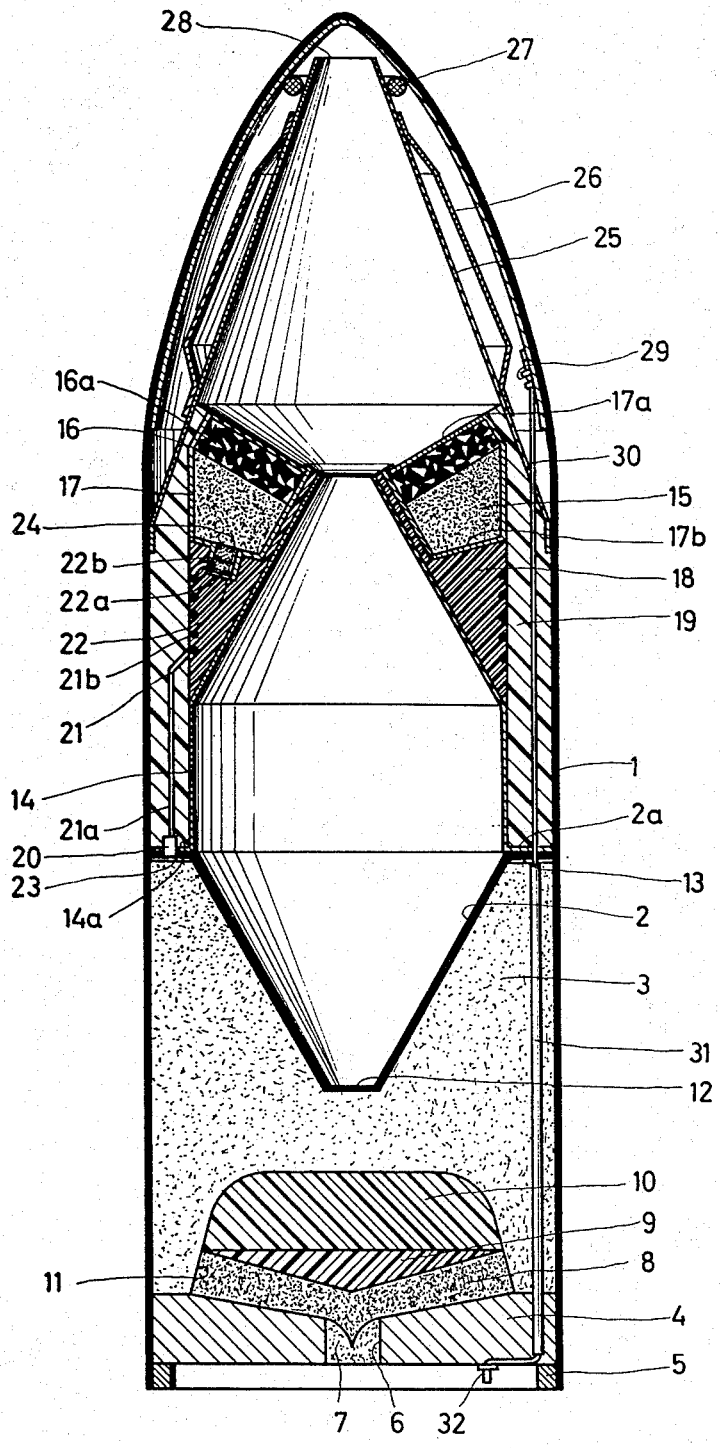
28
27
26
25
29
16a
17a
16
30
17
15
24
17b
22b
18
22a
19
22
21b
21
1
14
2a
21a
20
13
23
2
14a
3
31
12
10
9
8
11
4
5
7
6
32

WARHEAD FOR USE AGAINST ARMORED TARGETS

This is a short form continuation of application Ser. No. 3,609 filed Dec. 24, 1969, now abandoned.

SUMMARY OF THE INVENTION

The invention concerns a warhead for use against armored targets, comprising a shaped charge and an aftereffect produced by a second charge arranged in front of the shaped charge, the former being initiated by the shaped charge.

The armor-piercing effect of the standard shaped charge is insufficient for use against armored targets because upon penetration of the armoring the jet emerging from the shaped charge possesses only little energy which in general is not sufficient to cause large-scale destruction in the area behind the armoring. Furthermore, the remaining particles of the jet and/or slug hit only targets located in axial direction behind the armoring. The area outside, for example laterally to, the shaped charge axis, is not within the range of the shaped charge effect.

It is known the shaped charge effect can be increased by arranging a second explosive charge directly in front of the shaped charge, the ignition of both charges being initiated by the rearward positioned shaped charge solely. Using this method, a summation of the effects of both explosive charges can be achieved to a certain degree, but no additional aftereffect of the second explosive charge is developed in the area behind the armoring pierced by the shaped charge.

It is likewise known that the effect of explosive charges, in particular, shaped charges, can be increased utilizing a hollow body of any material which is located between the shaped charge and the target, and tapered in target direction. It is further known that this hollow body is arranged at some standoff from the target. The most favorable standoff between a shaped charge and a target located in the shaped charge axis can be determined by tests and so selected that, as a result of the detonation of the shaped charge, not only the armoring is penetrated, but also — especially when using the sleeve-type hollow body — a certain destructive effect is achieved in the area behind the armoring due to the expansion of the gas jet. But in practice the "most favorable standoff" cannot be observed in all instances.

Apart from this, even if the hollow body mentioned above is disposed in front of the shaped charge, the functioning of all targets not located along the effective axis is impaired either only to a small degree or not at all.

The present invention is directed to providing a warhead which is so designed that upon detonation of the shaped charge the detonation of a second charge will take place after a relatively long period of time when the shaped charge jet has already become effective but defore explosive products of the shaped charge have destroyed the second charge. With a 135 mm caliber design this time interval is approx. 55 to 60 μus. Further, it is imperative that the formation of gases from the second charge is avoided, if possible, in order not to destroy the shaped charge jet.

It is an object of the invention to provide the combination of the following features:

a. A hollow body tapered in target direction is disposed in front of the shaped charge.

b. A second annular explosive charge is arranged coaxially to the jet axis of the shaped charge in front of the latter.

c. The second explosive charge has an active liner.

d. A partially cylindrical and partially funnel-shaped sleeve tapered in target direction is arranged between the shaped charge and the second explosive charge as a means of protection.

e. The system transmitting the detonation from the shaped charge to the second explosive charge consists of detonation transmission elements comprising caps provided with boosters equally spaced from the inner circumference of the housing, as well as detonation cords.

Upon penetration of the armoring by means of the jet from the shaped charge an accordingly more intense and sufficiently destructive effect is to be produced behind the penetrated target by the detonation effect of the second explosive charge. The explosive charge located in front must have an appropriate bore, i.e. be annular in shape in order that the jet emerging from the shaped charge can be effective and the effect of both explosive charges on the common shaped charge axis be concentrical. Further, it must detonate at a defined time interval after the detonation of the shaped charge. Also, it should act according to the principle of secondary explosion, i.e. the mass from the active liner accelerated by the second explosive charge in axial direction shall pass through the conical funnel having the design and the effect of a nozzle and through the hole in the armoring produced by the shaped charge, and explode behind said armoring, utilizing atmospheric oxygen, whereby the shock wave incurred will cause effective destruction behind the armoring.

The performance of the warhead according to the invention can be advantageously increased by composing the active liner of the second charge consisting of metal powder and explosive binders in such a way that grain size and binding ensure an explosion approx. 500 to 1000 mm behind the armoring.

Only the procedure described ensures in practice the highly satisfactory effect in the interior of the tank, because otherwise the detonation effect of the first charge producing the jet destroys the second charge too early, i.e. almost simultaneously, so that penetration of the armoring has not yet been completed. The gases produced by an annular explosive charge without decelerating liner move too fast so that they reach the jet emerging from the shaped charge and destroy it, thus reducing the penetration capacity considerably.

Lengthy tests carried out amongst other things with regard to the liner design of the annular charge, the design of the protective sleeve arranged between shaped charge and second charge, and above all the initiation system and/or the detonation transmission system, led to the warhead design in the invention.

It is a feature of the invention that the light metal or steel sheet protective sleeve is surrounded by a protective cover, for instance, of plastic foam or rubber, consisting of filler pieces and holding the detonation transmission system in position. Said cover is used to fill the annular space between the protective sleeve and the housing of the warhead, and, in addition, to hold the second explosive charge in position.

An accurate and simultaneous initiation of the annular charge at at least six equally distributed points is required to blow the active mass through the conical portion.

Further, the detonation transmission system comprises primary explosive-free entrance booster charges and exit booster charges of the same kind which are connected via detonation cords having a length equivalent to the time delay required.

The caps containing the entrance booster charges are positioned within recesses of a flange at the rearward end of the protective sleeve disposed in the base plane of the shaped charge, projecting the annular face of the shaped charge, from which they are separated by a sheet.

It is another feature of the invention that the caps containing the exit booster charges are positioned in the forward face of a filler piece, their forward part, separated by a sheet serving as cover from the second annular explosive charge, being filled with a highly pressed explosive and their rearward part taking the end of the detonation cord being filled with a somewhat less pressed explosive.

As is well known, a prerequisite for obtaining a satisfactory shaped charge effect is that the jet is formed axially symmetrically. To achieve this purpose, the detonation wave must pass through the charge axially symmetrically. Only then does the shaped charge detonation wave reach all points of the base simultaneously, thus being capable of igniting the entrance booster charges simultaneously at any number of points, as far as the warhead described in the invention is concerned. Said entrance booster charges are used to transmit the detonation from the shaped charge to the detonation cords. The tests performed have shown that lead-sheathed detonation cords with a 1 mm core are well suited for the purpose in question. According to their detonation rate the length of the detonation cords can be so fixed that the time delay required is observed. This can be achieved by winding the detonation cords helically about a body or in a protective cover made, for instance, of plastic foam or the like. Each detonation cord ends in an exit booster charge, transmitting the detonation from the thin detonation cord core to said charge. Due to the detonation shock from the exit booster charge the second annular explosive charge is then initiated.

Special care must be taken to see that the time delays in detonation of the various transmission elements equally distributed over the circumference of the explosive charge are below 0.4μus. Time delays of this order are to be regarded as the upper limit in the event that the active liner mass of the second annular charge shall flow through the hole in the armoring pierced by the shaped charge jet.

Otherwise, that is when this time delay is only slightly exceeded, the exit booster charge of the annularly arranged detonation transmission elements which detonates first initiates the annular explosive charge eccentrically, the jet being displaced obliquely to the warhead axis in the direction of the side opposite the initiation point. Thus, the mass elements of the active liner can neither pass through the hole in the armoring pierced by the shaped charge nor react with the atmospheric oxygen behind, but hit the outside of the armoring beside the said hole without producing the desired effect.

Previous obstacles hindering the observance of the optimum initiation time have been removed by the arrangement of, for instance, eight detonation transmission elements equally distributed over the circumference of the explosive charges.

The initial tests carried out without using an active liner for the second explosive charge (annular charge), as already mentioned, now show, after the difficulties, which consisted above all in the uniform transmission of the detonation from the first charge to the overall circumference of the second charge, where overcome, that the effectiveness of the shaped charge is considerably reduced. This is due to the fact that the gases produced by the second charge reach the shaped charge jet too early and destroy it, thus eliminating the piercing effect.

On the one hand it is not possible to delay the detonation of the second charge (120 μus) until the piercing jet from the shaped charge has become fully effective before the gases from the second charge have reached it, and on the other, however, neither is decreased performance acceptable for a warhead.

Thus a way had to be found of effecting a detonation of the second explosive charge as late as possible, before the shaped charge effect destroys the annular charge, and that the jet has sufficient time to pierce the armoring before the annular charge effect destroys the jet.

As a result of further extensive tests this has been successfully achieved using the described arrangement.

It is a further feature of the invention that the detonation cords which transmit the detonation from the shaped charge to the annular explosive charge are laid, partly in the direction of the warhead axis, partly in helical windings, in the protective cover. Thereby the destruction of the detonation cords before their detonation is prevented due to the detonation effect of the shaped charge.

If the detonation cord windings are in direct contact with the base of the shaped charge and no axial laying of the detonation cords is incorporated in the detonation path, the gases from the shaped charge reach the first windings, as a result of their speed, already before the detonation in the cords has got so far. The percentages of the various types of laying, axial and helically wound, respectively, can be determined only approximately by computations. It was possible to determine the optimum through testing.

Furthermore, the tests mentioned have shown that it is advantageous to press the active liner of the second annular charge from granulated and oxidized metal powder, whereby, according to a further feature of the invention, the space between the metal grains can be filled with highly reactive masses, for instance, oxidizers or TNT (trinitrotoluol), admixed, if necessary, with a plastic binder or the like. In this way not only is the shaped charge jet protected from the gases from the second charge (annular charge), but an improved effectiveness of the active mass in comparison to the normal gases from an explosive charge is likewise obtained. The energy of the active mass is considerably higher than that of the gases.

Whereas explosion tests using iron as the inert liner of the second annular charge confirmed that the jet with piercing effect is retained, the next test step with an active liner was completely successful. The active mass of the liner of the second charge flowing through the hole in the armoring pierced by the shaped charge jet reacts actively behind the armoring with oxygen. This is an aftereffect reaction of the active substances, involving a high pressure effect. The speeds of the mass of the active liner amount to 2500 m/s as against 7000–8000 m/s the gases' speed. This speed depends on the volume of the second annular charge as well as on its shape and the type and mass of its liner.

A preferred embodiment of the invention is characterized by a conical-shaped nozzle of thin steel or light metal sheet which surrounds the second annular explosive charge. In accordance with the present invention, said nozzle positioned in the forward portion of the warhead may be the internal pole of an arming device used to initiate the shaped charge. The second pole may be in contact with conducting parts of the housing.

To form the jet emerging from the shaped charge, it is a further feature of the invention that the liner cone of the shaped charge has a truncated apex and its base an annular shape whose radius is at right angles to the warhead axis. In this way the hole cross section in the armoring is increased, i.e. the aftereffect is increased because the active mass can flow more easily through the larger hole into the interior of the target.

It is a further advantageous feature of the invention that the second explosive charge and its flat cone liner are surrounded by a casing having a central opening on the side pointing towards the shaped charge and bores to take the exit booster charges positioned in caps in the annular casing base.

DESCRIPTION OF A PREFERRED EMBODIMENT

The FIGURE shows a diagrammatic representation in axial section of a warhead with a shaped charge and a second annular explosive charge positioned in front of the former in target direction.

Positioned within the rearward portion of the warhead housing 1, for instance, of plastic or a similar material, is the shaped charge 3 provided with a conical liner 2. The rearward end of the housing 1 is fitted with a covering 4 secured by a clamping ring 5 in the rear periphery of the housing 1. Positioned within a central bore 6 of said covering 4 is a booster cylinder 7, the tip of a booster end plate 8 being fixed centrally therein. At the rear face of the explosive of the shaped charge 3 a cup-shaped recess with a conical wall 11 is provided, which serves to receive a two-piece "lens" 9,10 made of inert material. The punctiform initiation is effected by the booster links 7 and 8. The detonation wave is conducted by the inert "lens" 9,10 as desired so that axially symmetrical detonation of the explosive of the shaped charge 3 is obtained, thus insuring an optimum explosive effect of the shaped charge 3. To effect the formation of the jet produced by the shaped charge and increase the hole in the armoring pierced by the jet, the tip 12 of the conical liner 2 is truncated to form a circular area, thus increasing the hole cross section. To achieve the same purpose, the edge of the cast explosive of the shaped charge 3 directed towards the warhead nose is flattened so as to form a flat annular face 13 at right angles to the warhead axis, which face carries the flange **2*a* of the liner 2. Disposed centrally to the longitudinal axis of the warhead and on the flange 2*a* is the flange 14*a* of the funnel-shaped protective sleeve 14 open on either side and conical towards the warhead nose. Disposed concentrically to the protective sleeve 14 on the conical portion is a second annular charge 15 with its active liner 16. The design of said charge 15** is similar to that of a shaped charge, with its conical tip cut off at right angles to the cone axis, thus producing the annular shape and permitting the jet to pass.

To protect it against loads caused by the warhead during transportation or the like, the annular charge 15 and its active liner 16 are surrounded by a protective casing 17 and rigidly positioned within two filler pieces 18 and 19 of plastic foam and/or rubber. Said filler pieces are used to fill the annular space between the outside of the funnel-shaped protective sleeve 14 and the inner wall of the housing 1. The system conducting the detonation from the shaped charge 3 to the annular charge 15 is enclosed by said filler pieces 18 and 19, the transmission elements being equally distributed over the faces of both explosive charges 3 and 15 facing each other.

The drawing shows a sectional view of one of the transmission elements. Said elements can be arranged in any number exceeding 6, but preferably 8. They must invariably be equally spaced, i.e. equally distributed over the circumference. Each transmission element comprises three interconnected parts, namely:

a. The entrance booster charge consists of a cap 20 filled with the appropriate explosive. Its purpose is to transmit the detonation from the shaped charge 3 to the detonation cord 21. The rearward face of the cap 20 is covered by a sheet 23 so as not to impede smooth detonation transmission from the shaped charge 3 to the booster charge.

b. The detonation cord 21 connected to the cap 20 is laid and fixed in grooves or similar recesses provided for in the filler pieces 18,19 of plastic foam and/or rubber. Its first part **21*a* runs in axial direction of the warhead, whereas its second part 21*b* is wound helically about the cylinder of the filler piece 18**.

c. The exit booster charge likewise consists of a cap 22 into which the detonation cord 21 is led laterally in radial direction. The end of the detonation cord is introduced for a length of some millimeters into the rear part **22*a* of the interior of the cap, to insure immediate initiation. The rear part 22*a* of the interior of the cap 22 is filled with an only slightly pressed explosive, for instance, Nitroponta, while the front part 22*b* is filled with the same or a comparable, but more strongly pressed, explosive. The caps 22 with the exit booster charges, equally distributed over the face of the second annular charge 15, are covered by the sheet 24 to avoid an asymmetrical transmission of the detonation to the charge 15**.

Disposed over the outer circumference of the vibration and shock-absorbing filler piece 19 is a nozzle 25, tapered towards the warhead nose, which is used to hold in positon amongst other things the second annular charge 15 and its flat cone liner 16 in the casing 17 so that they cannot break out even in the case of bumps and loads caused by the warhead. The contact clips 26 are arranged on the outer circumference of the nozzle 25. Said contact clips are used to make contact with a conducting layer located in the top of the housing 1, on impact of the warhead with the target and upon its deformation due to the impact. The connection of the ignition cable to one of the said contact clips 26 is not shown in the drawing.

In the illustrated embodiment the insulating ring 27, positioned on the outer circumference of the nozzle 25 and supported by the inner wall of the housing 1, serves to prevent any unforeseen contact. The nozzle 25 has a central opening 28 at its top through which the jet produced by the shaped charge 3 passes before the second annular charge 15 detonates, accelerating its active liner 16 and flowing through the hole in the armoring pierced by the shaped charge jet. It then explodes behind the armoring, where it produces an effective shock wave, thus achieving the desired effect.

The ignition cable 3*o* connected at 29 to a metal liner in the front portion of the housing 1 is led through the filler piece 19 and the tube 31, the latter, in turn, being led through the shaped charge 3 and the covering 4. The end 32 of the ignition cable 3*o* provided with a connector protrudes from the surface of the covering 4. Only the ignition cable is shown in the drawing.

Ignition is effected in the usual way, utilizing an arming device. While specific embodiments of the invention have been shown and described in detail to illustrate the application of the inventive principles, it will be understood that the invention may be embodied otherwise without departing from such principles.

What is claimed is:

1. A warhead for use against armored targets, comprising an axially elongated warhead housing, a forward or nose end and a rearward end, a shaped first charge located within and at the rearward end of said housing and having a conically shaped liner, with the axis of said liner extending in the axial direction of said housing, and with the sides of the liner diverging in the direction of the forward end of said housing, an open-ended protective sleeve located within and spaced inwardly from said housing and extending toward the forward end of said housing from the end of said first charge closer to the forward end of said housing, said protective sleeve being concentric to the axis of said liner and comprising a cylindrically shaped portion extending axially from the end of said first charge closer to the forward end of said housing, and a truncated conical portion extending from said cylindrically shaped portion toward the forward end of said housing with the sides of said conical portion converging toward the forward end of said housing, the smaller end of said truncated conical portion being spaced from the forward end of said housing, an annular second charge concentrically positioned about said conical portion, an active liner disposed in contact with the surface of said second charge which faces toward the forward end of said housing, filler means located within the space between said protective sleeve and said housing for rigidly positioning said second charge and active liner, and ignition means extending between said first charge and said second charge for igniting said second charge from said first charge with a predetermined time delay after the ignition of said first charge, said ignition means comprising a first cap containing an explosive in contact with the end surface of said first charge closer to the forward end of said housing, a second cap containing an explosive in contact with the end surface of said second charge directed toward the forward end of said housing, and detonation cord extending through said filler means between said first cap and said second cap.

2. A warhead as set forth in claim 1, wherein the detonation cord having a length equivalent to the time delay required.

3. A warhead as set forth in claim 1, wherein said detonation cord extends in the axial direction through said filler means from said first cap for a part of the axial dimension between said first and second charges and then extends helically through said filler means about said protective sleeve to said second cap.

4. A warhead as set forth in claim 1, wherein said detonation cord extends in the axial direction through said filler means from said first cap for at least the axial length of the cylindrically shaped portion of said protective sleeve, and for at least a portion of the axial length of the conical portion of said protective sleeve wherein said detonation cord extends helicallly through said filler means about said protective sleeve terminating in said second cap.

5. A warhead as set forth in claim 1, wherein said filler means comprises an axially extending cylindrically shaped filler sleeve concentric to the axis of said protective sleeve and co-extensive with said protective sleeve, said filler sleeve having an inside diameter approximately equal to the outside diameter of the cylindrical portion of said protective sleeve, and an axially extending filler ring having a wedge shape in axially extending radial section, and located concentrically about the conical portion of said protective sleeve, and extending between the conical portion and the filler sleeve, and extending rearwardly from the rearward end of said second charge.

6. A warhead as set forth in claim 5, wherein said filler means is formed of plastic foam.

7. A warhead as set forth in claim 5, wherein said filler means is formed of rubber.

8. A warhead as set forth in claim 1, wherein a protective casing encloses said second charge and active liner.

9. A warhead as set forth in claim 1, wherein said active liner is pressed from granulated oxidized metal powder.

10. A warhead as set forth in claim 9, wherein the interstices in the metal powder are filled with a highly reactive mass.

11. A warhead as set forth in claim 10, wherein said highly reactive mass comprises oxidizers, TNT, and a plastic binder.

12. A warhead as set forth in claim 1, wherein a frusto-conical nozzle is located within said housing and extends from the end of said filler means enclosing said second charge toward the forward end of said housing to a location adjacent to the forward end of said housing, and contact means mounted on the outer surface of said nozzle, said contact means engageable with said housing upon impact and detonation of said housing.

13. A warhead as set forth in claim 12, wherein said nozzle forms an internal pole of an arming device used to ignite said first charge and said nozzle includes a second pole arranged to contact a conducting part of the warhead.

* * * * *